US007549741B2

(12) United States Patent
Katase et al.

(10) Patent No.: US 7,549,741 B2
(45) Date of Patent: Jun. 23, 2009

(54) RECORDING HEAD, RECORDING APPARATUS, AND RECORDING SYSTEM

(75) Inventors: Makoto Katase, Nagano (JP); Yoshiyuki Koike, Nagano (JP)

(73) Assignee: Seiko Epson Corporation (JP)

( * ) Notice: Subject to any disclaimer, the term of this patent is extended or adjusted under 35 U.S.C. 154(b) by 432 days.

(21) Appl. No.: 11/159,060

(22) Filed: Jun. 22, 2005

(65) Prior Publication Data

US 2006/0024602 A1 Feb. 2, 2006

(30) Foreign Application Priority Data

Jul. 28, 2004 (JP) ..... 2004-220707

(51) Int. Cl.
*G03G 9/00* (2006.01)

(52) U.S. Cl. ..... 347/106; 347/55; 347/65; 347/85; 347/226; 349/42

(58) Field of Classification Search ..... None
See application file for complete search history.

(56) References Cited

U.S. PATENT DOCUMENTS 3,305,841 A * 2/1967 Schwartz ..... 347/226
3,977,323 A * 8/1976 Pressman et al. ..... 347/55
5,036,341 A * 7/1991 Larsson ..... 347/55
5,424,817 A * 6/1995 Imamiya et al. ..... 399/281
5,631,679 A * 5/1997 Kagayama ..... 347/55
5,742,884 A * 4/1998 Germain et al. ..... 399/266
5,889,541 A * 3/1999 Bobrow et al. ..... 347/55
6,126,275 A * 10/2000 Kagayama ..... 347/55
6,290,342 B1 * 9/2001 Vo et al. ..... 347/85
6,309,049 B1 * 10/2001 Salmon ..... 347/55
6,572,219 B1 * 6/2003 Sundstrom ..... 347/55
2003/0001925 A1 * 1/2003 Ogawa et al. ..... 347/55
2005/0104936 A1 * 5/2005 Conta et al. ..... 347/65

FOREIGN PATENT DOCUMENTS

JP 07-152232 6/1995
JP 11-078104 3/1999

* cited by examiner

*Primary Examiner*—Matthew Luu
*Assistant Examiner*—John P Zimmermann
(74) *Attorney, Agent, or Firm*—Harness, Dickey & Pierce, P.L.C.

(57) ABSTRACT

A recording head records an image on a medium. The recording head includes a recording agent bearing portion that bears a recording agent to be transferred onto the medium for the image to be recorded thereon, and an active element that deposits the recording agent on the recording agent bearing portion according to image information of the image.

9 Claims, 8 Drawing Sheets

RECORDING HEAD, RECORDING APPARATUS, AND RECORDING SYSTEM

RELATED APPLICATIONS

This application claims priority to Japanese Patent Application No. 2004-220707 filed Jul. 28, 2004 which is hereby expressly incorporated by reference herein in its entirety.

BACKGROUND OF THE INVENTION

1. Technical Field

The present invention relates to a recording head, a recording apparatus, and a recording system.

2. Related Art

As a recording apparatus, such as a printer, there is an apparatus that records an image on a medium, such as a recording sheet of paper, by transferring a recording agent, such as toner, onto the medium through the control of active elements, such as thin film transistors (TFTs), according to image information of the image.

In an example of such a recording apparatus, a recording agent supply (reservoir) device is placed oppositely to a medium via an aperture electrode body, and whether or not the recording agent within the recording agent supply (reservoir) device is allowed to pass through the aperture electrode body is controlled by means of active elements according to image information of an image. The recording agent is therefore transferred onto the medium according to the image information, and the image is thus recorded on the medium (see JP-A-11-78104).

In another example of such a recording apparatus, a recording agent supply (reservoir) device is placed oppositely to an electrode via a medium, and potential of the electrode is controlled by means of active elements according to image information of an image. The charged recording agent within the recording agent supply (reservoir) device is therefore transferred onto the medium according the image information, and the image is thus recorded on the medium (see JP-A-7-152232).

Both examples of the recording apparatus, however, have problems as follows. That is, when the method using apertures (openings) as is disclosed in JP-A-11-78104 supra is adopted, the apertures are narrowed when resolution is increased, which readily gives rise to clogging. It is therefore difficult to achieve a fast, high-resolution, and yet reliable product. With the method disclosed in JP-A-7-152232 supra, because the recording agent supply (reservoir) device itself opposes the medium, it is highly probable that the recording agent within the recording agent supply (reservoir) device adheres to the medium in spite of the control described above. When such an event takes place, an image is not recorded on the medium according to the image information, and the image quality is deteriorated. In addition, because an electric field is applied via the medium, most of a voltage for controlling the recording agent is applied to the medium. Hence, an extremely high voltage (some hundreds V) needs to be applied to TFTs. This, however, is infeasible in a practical process using TFTs of a practical size.

SUMMARY

An advantage of the invention is therefore to achieve a recording head, a recoding apparatus, and a recording system, each of which is capable of recording a high-quality image.

A first aspect of the invention provides a recording head that records an image on a medium, which includes a recording agent bearing portion that bears a recording agent to be transferred onto the medium for the image to be recorded thereon, and an active element that deposits the recording agent on the recording agent bearing portion according to image information of the image.

The recording head configured in this manner is able to record a high-quality image.

The active element may be a thin film transistor.

In this case, it is possible to deposit the recording agent on the recording agent bearing portion swiftly.

More than one set of the recording agent bearing portion and the active element may be provided, and the recording agent bearing portion and the active element in each set may correspond to one pixel in the image.

The recording agent may be charged to a specific polarity, so that the active element deposits the recording agent on the recording agent bearing portion according to the image information of the image by charging the recording agent bearing portion to a polarity opposite to the specific polarity.

The active element may charge the recording agent bearing portion to the specific polarity when the recording agent is transferred onto the medium, so that the recording agent deposited on the recording agent bearing portion is forced away from the recording agent bearing portion.

In this case, the recording agent can be transferred onto the medium more appropriately.

The recording head may include, as the recording agent bearing portion, a first recording agent bearing portion that bears the recording agent according to the image information of the image, a second recording agent bearing portion that opposes the medium, and a third recording agent bearing portion that forms a moving path for the recording agent from the first recording agent bearing portion to the second recording agent bearing portion. Meanwhile, the active element may deposit the recording agent on the first recording agent bearing portion according to the image information of the image, then move the recording agent to the second recording agent bearing portion from the first recording agent bearing portion by way of the third recording agent bearing portion, and force the recording agent that has moved to the second recording agent bearing portion away from the second recording agent bearing portion.

In this case, it is possible to take a countermeasure to prevent the recording agent that was deposited erroneously on the first recording agent bearing portion from being deposited on the second recording agent bearing portion in the end.

The recording head may be curved, so that a direction heading toward the second recording agent bearing portion from the first recording agent bearing portion does not go along a direction heading toward the third recording agent bearing portion from the first recording agent bearing portion.

In this case, the recording agent deposited on the second recording agent bearing portion can be transferred onto the medium more appropriately.

The recording agent bearing portion may be allowed to move, so that, after the active element deposits the recording agent on the recording agent bearing portion according to the image information of the image, the recording agent bearing portion bearing the recording agent moves to an opposing position at which the recording agent bearing portion opposes the medium, while the active element forces the recording agent deposited on the recording agent bearing portion that has moved to the opposing position away from the recording agent bearing portion.

In this case, the control performed by means of the active element can be simpler.

The recording head may be a cylindrical member having the recording bearing portion on a surface thereof, so that the recording agent bearing portion bearing the recording agent moves to the opposing position in association with rotations of the recording head.

In this case, the recording head having the advantages as described above, that is, the recording head in which the control by means of the active element is simpler, can be achieved through a simple method.

The active element may be a thin film transistor, and the thin film transistor may be an organic transistor.

In this case, the recording head can be readily manufactured.

The active element may be a thin film transistor, and the thin film transistor may be made of low-temperature polycrystalline silicon.

In this case, a recording head having highly accurate thin film transistors can be readily manufactured.

A second aspect of the invention provides a recording head that records an image on a medium, which includes a recording agent bearing portion that bears a recording agent to be transferred onto the medium for the image to be recorded thereon, and an active element that deposits the recording agent on the recording agent bearing portion according to image information of the image. The active element is a thin film transistor, and more than one set of the recording agent bearing portion and the active element is provided. The recording agent bearing portion and the active element in each set correspond to one pixel in the image. The recording agent is charged to a specific polarity, so that the active element deposits the recording agent on the recording agent bearing portion according to the image information of the image by charging the recording agent bearing portion to a polarity opposite to the specific polarity. The active element charges the recording agent bearing portion to the specific polarity when the recording agent is transferred onto the medium, so that the recording agent deposited on the recording agent bearing portion is forced away from the recording agent bearing portion. The recording head includes, as the recording agent bearing portion, a first recording agent bearing portion that bears the recording agent according to the image information of the image, a second recording agent bearing portion that opposes the medium, and a third recording agent bearing portion that forms a moving path for the recording agent from the first recording agent bearing portion to the second recording agent bearing portion. The active element deposits the recording agent on the first recording agent bearing portion according to the image information of the image, then moves the recording agent to the second recording agent bearing portion from the first recording agent bearing portion by way of the third recording agent bearing portion, and forces the recording agent that has moved to the second recording agent bearing portion away from the second recording agent bearing portion. The thin film transistor is made of low-temperature polycrystalline silicon.

The recording head configured in this manner achieves most of the advantages described above, and therefore achieves the advantage of the invention more effectively.

A third aspect of the invention provides a recording apparatus provided with a recoding head that records an image on a medium, which includes a recording agent bearing portion that bears a recording agent to be transferred onto the medium for the image to be recorded thereon, and an active element that deposits the recording agent on the recording agent bearing portion according to image information of the image.

The recording apparatus configured in this manner is able to record a high-quality image.

The recording apparatus may further include: a charging member that charges the recording agent to a specific polarity, and an oppositely-charged member that is provided at an opposing position at which the oppositely-charged member opposes the recording head via the medium and is charged to a polarity opposite to the specific polarity when the recording agent is transferred onto the medium. The charging member may charge the recording agent to the specific polarity, so that the active element deposits the recording agent charged to the specific polarity on the recording agent bearing portion according to the image information of the image by charging the recording agent bearing portion to the polarity opposite to the specific polarity. The active element, when the recording agent is transferred onto the medium, may force the recording agent deposited on the recording agent bearing portion away from the recording agent bearing portion by charging the recording agent bearing portion to the specific polarity while the oppositely-charged member is charged to the polarity opposite to the specific polarity for the recording agent to be attracted toward the medium.

In this case, the recording agent can be transferred onto the medium more appropriately.

The recording head may include, as the recording agent bearing portion, a first recording agent bearing portion that bears the recording agent according to the image information of the image, a second recording agent bearing portion that opposes the medium, and a third recording agent bearing portion that forms a moving path for the recording agent from the first recording agent bearing portion to the second recording agent bearing portion. Meanwhile, the active element may deposit the recording agent on the first recording agent bearing portion according to the image information of the image, then move the recording agent to the second recording agent bearing portion from the first recording agent bearing portion by way of the third recording agent bearing portion, and force the recording agent that has moved to the second recording agent bearing portion away from the second recording agent bearing portion. Also, the medium may be a recording sheet of paper, and the recording apparatus may further include a feeding portion from which the recording sheet of paper is fed. Further, a surface length of the recording head is shorter than a minimum length of a recording sheet of paper that can be fed from the feeding portion.

In this case, because the recording head can be reduced in size, a compact recording apparatus can be achieved.

A fourth aspect of the invention provides a recording system, including a computer, and a recoding apparatus connected to the computer. The recording apparatus has a recoding head that records an image on a medium. The recording head includes a recording agent bearing portion that bears a recording agent to be transferred onto the medium for the image to be recorded thereon, and an active element that deposits the recording agent on the recording agent bearing portion according to image information of the image.

The recording system configured in this manner is able to record a high-quality image.

BRIEF DESCRIPTION OF THE DRAWINGS

The invention will be described with reference to the accompanying drawings, wherein like numbers reference like elements, and wherein.

DESCRIPTION OF THE EMBODIMENTS

Hereinafter, embodiments of the invention will be described in detail with reference to the drawings.

(Example of Configuration of Overall Recording Apparatus)

Figure 1:
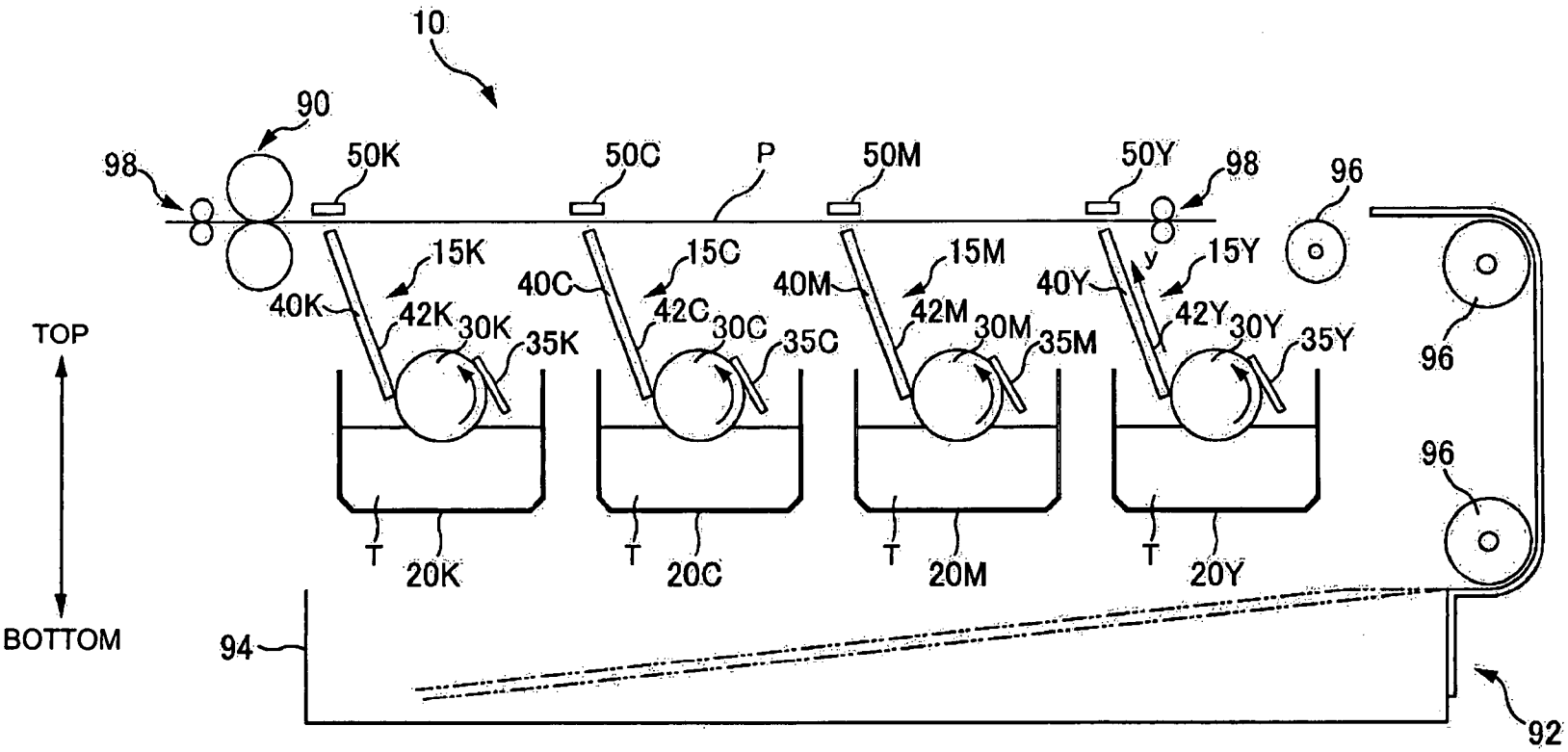
FIG. 1 is a view showing major components forming a printer.

A recoding apparatus of the invention will be described briefly with reference to FIG. 1 using a printer 10 as an example. FIG. 1 is a view schematically showing major components forming the printer 10. An arrow in FIG. 1 indicates top and bottom directions. For example, a paper feeding tray 94 is provided at the bottom of the printer 10, and a fixing unit 90 is disposed at the top of the printer 10. An arrow y in FIG. 1 indicates a direction from bottom to top of a recoding head 40Y (hereinafter, referred to also as the longitudinal direction of the recording head 40Y).

As is shown in FIG. 1, the printer 10 according to this embodiment includes four recording units 15Y, 15M, 15C, and 15K, the fixing unit 90, a paper feeding unit 92 as an example of a feeding portion, and transportation rollers 98. Further, the printer 10 includes an unillustrated display unit comprising a liquid crystal panel and serving as a notifying portion that notifies the user of information, and a control unit 100 (FIG. 2) that controls these units for them as a whole to operate as a printer.

Each of the recording units 15Y, 15M, 15C, and 15K is furnished with a function of recording an image on a recording sheet of paper P as an example of a medium using toner T as an example of a recording agent. The recording units 15Y, 15M, 15C, and 15K record images on the recording sheet of paper P using yellow (Y) toner T, magenta (M) toner T, cyan (C) toner T, and black (K) toner T, respectively. Because all the recording units 15Y, 15M, 15C, and 15K are of the same configuration, the recording unit 15Y will be described as a representative.

As is shown in FIG. 1, the recording unit 15Y includes a toner reservoir portion 20Y, a toner supply roller 30Y, a limiting blade 35Y as an example of a charging member, a recording head 40Y, and a back plate 50Y as an example of an oppositely-charged portion.

The toner reservoir portion 20Y stores yellow (Y) toner T. Toner T stored in the toner reservoir portion 20Y is dry toner that has been used normally.

The toner supply roller 30Y is a cylindrical member, and supplies the recording head 40Y with toner T stored in the toner reservoir portion 20Y. The toner supply roller 30Y is provided oppositely to the bottom of the recording head 40Y in such a manner that it comes into contact with toner T within the toner reservoir portion 20Y at the bottom. Also, the toner supply roller 30Y is supported rotatably on an unillustrated toner supply roller supporting portion.

The limiting blade 35Y abuts on the toner supply roller 30Y along its longitudinal direction, and charges toner T on the toner supply roller 30Y to a negative polarity as an example of a specific polarity. The limiting blade 35Y comprises an elastic body, such as urethane rubber, and is supported on an unillustrated limiting blade supporting member. The limiting blade 35Y is also furnished with a function of limiting a layer thickness of toner T by abutting on the toner supply roller 30Y.

The recording head 40Y bears toner T, which has been charged to the negative polarity by the limiting blade 35Y and supplied from the toner supply roller 30Y, on its surface 42Y. The recording head 40Y then transfers the toner T it bears onto a recording sheet of paper P for an image to be recorded on the recording sheet of paper P. The recording head 40Y will be described more in detail below.

The back plate 50Y is provided at an opposing position at which it opposes the top portion of the recording head 40Y via a recording sheet of paper P. The back plate 50Y is charged to a polarity (positive polarity) opposite to the specific polarity (negative polarity), so that toner T deposited on the recording head 40Y is attracted appropriately toward the recording sheet of paper P when the toner T is transferred onto the recording sheet of paper P. For example, a voltage of +500V is applied from an unillustrated d.c. power supply to the back plate 50Y when the toner T deposited on the recording head 40Y is transferred onto the recording sheet of paper P.

The fixing unit 90 fuse-bonds an image (toner image) recorded on the recording sheet of paper P to form a permanent image on the recording sheet of paper P.

The paper feeding unit 92 feeds a recording sheet of paper P to the recording units 15Y, 15M, 15C, and 15K. The paper feeding unit 92 includes the paper feeding tray 94 and paper feeding rollers 96. A recording sheet of paper P is fed from the paper feeding tray 94 to the recording units 15Y, 15M, 15C, and 15K by means of the paper feeding rollers 96.

The transportation rollers 98 transport a recording sheet of paper P fed from the paper feeding unit 92 to the recording units 15Y, 15M, 15C, and 15K.

(Example of Configuration of Control Unit)

An example of the configuration of the control unit 100 will now be described with reference to FIG. 2.

Figure 2:
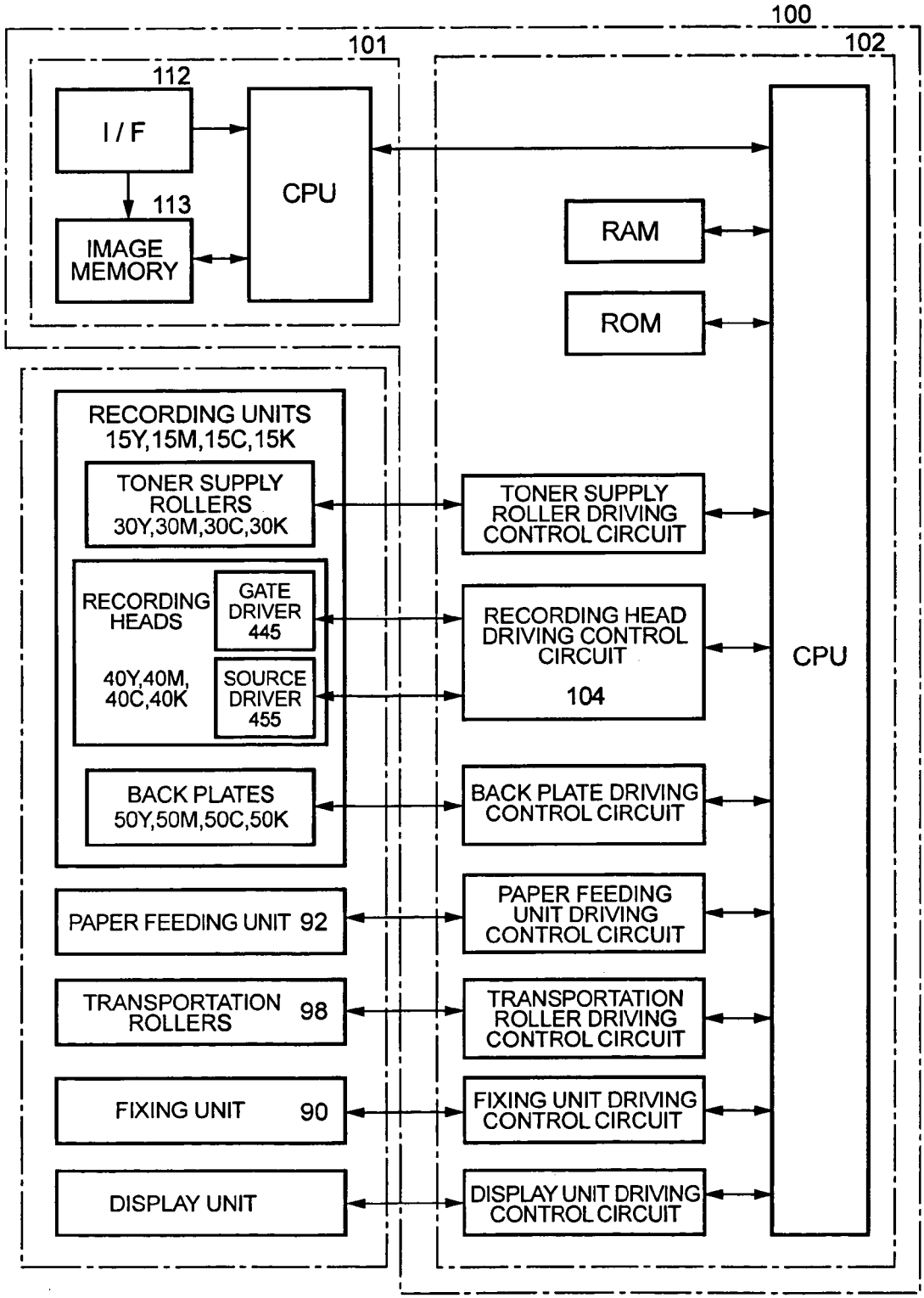
FIG. 2 is a block diagram showing a control unit in the printer of FIG. 1.

As is shown in FIG. 2, the control unit 100 comprises a main controller 101 and a unit controller 102. Image information (image signal) of an image and a control signal are inputted into the main controller 101. The unit controller 102 records an image by controlling respective units at commands according to the image information (image signal) and the control signal.

The main controller 101 is connected to a host computer via an interface 112, and includes an image memory 113 to store the image information (image signal) inputted from the host computer. The unit controller 102 is electrically connected to the respective units (the recording units 15Y, 15M, 15C, and 15K, the fixing unit 90, the paper feeding unit 92, the transportation rollers 98, and the display unit). The unit controller 102 controls the respective units according to an input signal from the main controller 101 while receiving signals from sensors provided to the respective units from time to time to detect the states of the respective units.

(Example of Configuration of Recording Head)

Figure 3:
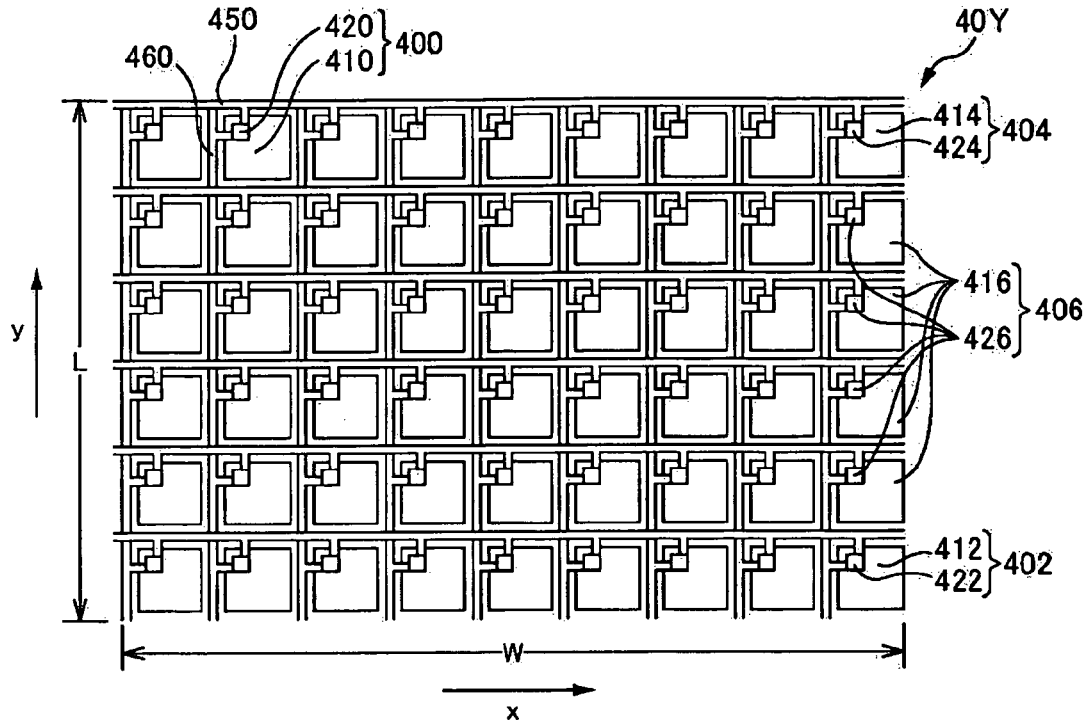
FIG. 3 is a view schematically showing the surface of a recording head.
Figure 4:
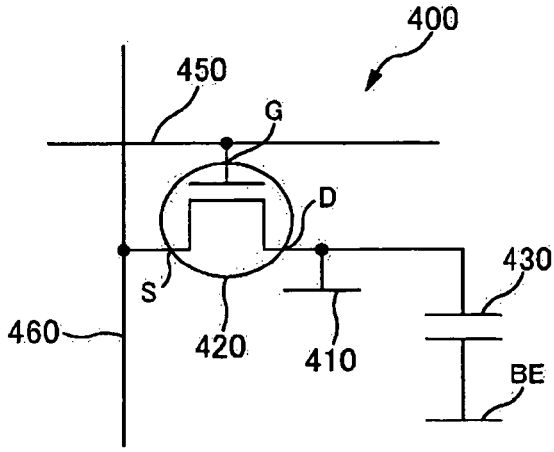
FIG. 4 is a view used to describe an electrical connection of major components forming the recording head.

An example of the configuration of the recording heads 40Y, 40M, 40C, and 40K will now be described with reference to FIG. 3 and FIG. 4. FIG. 3 is a view schematically showing the surface 42Y of the recording head 40Y. FIG. 4 is a view used to describe electrical connections among major components of the recording head 40Y. In order to illustrate the alignment of pixel circuits 400 clearly, the number of the pixel circuits 400 shown in FIG. 3 is smaller than the actual number of the pixel circuits 400. Referring to FIG. 3, as with FIG. 1, the longitudinal direction of the recording head 40Y is indicted by an arrow y, and a direction perpendicular to the longitudinal direction (hereinafter, referred to also as the lateral direction of the recording head 40Y) is indicated by an arrow x. The lateral direction of the recording head 40Y corresponds to a direction penetrating through the sheet surface of FIG. 1.

As has been described, the printer 10 is provided with four recording heads 40Y, 40M, 40C, and 40K, and because all the recording heads 40Y, 40M, 40C, and 40K are of the same configuration, the recording head 40Y will be described as a representative.

The recording head 40Y comprises a thin flat plate, and as is shown in FIG. 3, is provided with the pixel circuits 400, a gate driver 445 (FIG. 2), gate lines 450, a source driver 455 (FIG. 2), and source lines 460 on the surface 42Y.

As is shown in FIG. 4, each pixel circuit 400 includes, as major components, a pixel electrode 410 as an example of a recording agent bearing portion, a thin film transistor (hereinafter, abbreviated as TFT) 420 as an example of an active element, and a capacitor (condenser) 430. As is shown in FIG. 3, plural pixel circuits 400 are provided lattice-wise on the surface 42Y of the recording head 40Y. These plural pixel circuits 400 have a one-to-one correspondence with the pixels forming the image. In other words, the recording head 40Y includes plural sets of the pixel electrode 410, the TFT 420, and the capacitor (condenser) 430, while the pixel electrode 410, the TFT 420, and the capacitor (condenser) 430 in each set correspond to one pixel in the image. In the recording head 40Y according to this embodiment, the pixel circuits 400 are aligned at pitches of about 42 μm, which determines the resolution (the number of pixels per inch) to be about 600 dpi.

The number of pixel circuits 400 provided to the recording head 40Y will now be considered. To begin with, the number of pixel circuits 400 aligned in the lateral direction x will be considered. In this embodiment, the surface width W of the recording head 40Y in the lateral direction x is matched with the maximum width of a recording sheet of paper P that can be fed from the paper feeding unit 92 (that is, the paper width of a largest recording sheet of paper P among recording sheets of paper P that can be fed from the paper feeding unit 92). Hence, the number of pixel circuits 400 aligned in the lateral direction x of the recording head 40Y takes a value equal to the product of the maximum width of the recording sheet of paper P and the resolution (the number of pixels per inch, namely, 600 dpi). For instance, given 210 mm (8.27 inches, or the paper width of A-4 size paper) as the maximum width of the recording sheet of paper P, then about 5000 pixel circuits 400 are aligned in the lateral direction x.

Next, the number of pixel circuits 400 aligned in the longitudinal direction y of the recording head 40Y will be considered. In this embodiment, the surface length L in the longitudinal direction y of the recording head 40Y is shorter than the minimum length of a recording sheet of paper P that can be fed from the paper feeding unit 92 (that is, the paper length of a smallest recording sheet of paper P among recording sheets of paper P that can be fed from the paper feeing unit 92). Hence, the number of pixel circuits 400 aligned in the longitudinal direction y of the recording head 40Y takes a value smaller than the product of the minimum length of the recording sheet of paper P and the resolution (the number of pixels per inch, namely, 600 dpi). For instance, given 148 mm (5.83 inches, or the paper length of a postcard-size paper), then less than 3500 pixel circuits 400 are aligned in the longitudinal direction y (in this embodiment, assume that 3000 pixel circuits 400 are aligned in the longitudinal direction y).

As has been described, the recording head 40Y is provided oppositely to the toner supply roller 30Y at the bottom, and to the back plate 50Y at the top via a recording sheet of paper P. To be more specific, of about 3000 pixel circuits 400 aligned in the longitudinal direction y, the pixel circuits 400 present at the lowermost position (the pixel circuits 400 in the first row in the longitudinal direction y) oppose the toner supply roller 30Y. Also, of about 3000 pixels circuits 400 aligned in the longitudinal direction y, the pixel circuits 400 present at the uppermost position (the pixel circuits 400 in the about $3000^{th}$ row in the longitudinal direction y) oppose the back plate 50Y (or a recording sheet of paper P) via the recording sheet of paper P.

Herein, for ease of description, about 5000 pixel circuits 400 present at the lowermost position and opposing the toner supply roller 30Y are referred to as first pixel circuits 402. The pixel electrode 410 and the TFT 420 provided in each first pixel circuit 402 are referred to as a first pixel electrode 412 as an example of a first recording agent bearing portion and a first TFT 422, respectively. Likewise, about 5000 pixel circuits 400 present at the uppermost position and opposing the back plate 50Y via a recording sheet of paper P are referred to as second pixel circuits 404. The pixel electrode 410 and the TFT 420 provided in each second pixel circuit 404 are referred to as a second pixel electrode 414 as an example of a second recording agent bearing portion and a second TFT 424, respectively. The other pixel circuits 400 are referred to as third pixel circuits 406. The pixel electrode 410 and the TFT 420 provided in each third pixel circuit 406 are referred to as a third pixel electrode 416 as an example of a third recording agent bearing portion and a third TFT 426, respectively. Referring to FIG. 3, nine pixel circuits 400 in the first row correspond to the first pixel circuits 402, nine pixel circuits 400 in the sixth row correspond to the second pixel circuits 404, and the rest of 36 pixel circuits 400 in the second through fifth rows correspond to the third pixel circuits 406.

The major components of the pixel circuits 400 will now be described one by one.

The pixel electrode 410 plays a role in depositing toner T that will be transferred onto a recording sheet of paper P for an image to be recorded on the recording sheet of paper P. To be more specific, the pixel electrode 410 is charged to a polarity (positive polarity) opposite to the polarity (negative polarity) of charged toner T through the functions of the TFT 420 and the capacitor (condenser) 430 described below, so that toner T, being attracted due to a Coulomb's force induced between the toner T and the pixel electrode 410, is deposited thereon. As is shown in FIG. 4, the pixel electrode 410 is electrically connected to the drain of the TFT 420.

The TFT 420, in cooperation with the capacitor (condenser) 430, plays a role in depositing toner T on the pixel electrode 410. To be more specific, as will be described below, the TFT 420, in cooperation with the capacitor (condenser) 430, deposits toner T on the pixel electrode 410 by charging the pixel electrode 410 to a polarity (positive polarity) opposite to the polarity (negative polarity) of charged toner T. The TFT 420 comprises, for example, an Nch transistor made of low-temperature polycrystalline silicon, and includes a gate G, a source S, and a drain D. As is shown in FIG. 4, the gate G is electrically connected to the gate line 450, the source S to the source line 460, and the drain D to both the pixel electrode 410 and the capacitor (condenser) 430.

The capacitor (condenser) 430, in cooperation with the TFT 420, plays a role in depositing the toner T on the pixel electrode 410. To be more specific, as will be described below, the capacitor (condenser) 430, in cooperation with the TFT 420, deposits toner T on the pixel electrode 410 by charging the pixel electrode 410 to a polarity (positive polarity) opposite to the polarity (negative polarity) of charged toner T. As is shown in FIG. 4, the capacitor (condenser) 430 is electrically connected to the drain D of the TFT 420 at one end, and to reference potential BE (20 V, in this embodiment) at the other end.

The gate driver 445 applies a predetermined voltage to the gate G of the TFT 420 via the gate line 450 according to a control signal sent from a recording head driving control circuit 104 (see FIG. 2) inside the unit controller 102. The gate driver 445 is electrically connected to both the recording head driving control circuit 104 and each gate line 450.

Also, as is shown in FIG. 3, plural gate lines 450 are provided in a direction along the lateral direction x of the recording head 40Y. The number of the gate lines 450 is equal to the number of TFTs 420 (pixel circuits 400) (about 3000, herein) aligned in the longitudinal direction y of the recording head 40Y. The gate lines 450 are electrically connected, respectively, to the gates G of the TFTs 420 aligned in the lateral direction x. In short, the respective gates G of the 5000 TFTs 420 are electrically connected to a single gate line 450.

The gate driver 445 is therefore able to apply a predetermined voltage to the respective gates G of about 5000 TFTs 420 via a single gate line 450.

The source driver 455 applies a predetermined voltage to the source S of the TFT 420 via the source line 460 according to a control signal sent from the recording head driving control circuit 104. The source driver 455 is electrically connected to both the recording head driving control circuit 104 and each source line 460.

As is shown in FIG. 3, plural source lines 460 are provided in a direction along the longitudinal direction y of the recording head 40Y. The number of the source lines 460 is equal to the number of TFT 420 (pixel circuits 400) (about 5000, herein) aligned in the lateral direction x of the recording head 40Y. The source lines 460 are electrically connected, respectively, to the sources S of the TFTs 420 aligned in the longitudinal direction y. In short, the respective sources S of about 3000 TFTs 420 are electrically connected to a single source line 460.

The source driver 455 is therefore able to apply a predetermined voltage to the respective sources S of about 3000 TFTs 420 via a single source line 460.

As has been described, the TFT 420 and the capacitor 430 operate in cooperation in depositing toner T on the pixel electrode 410 by charging the pixel electrode 410 to a polarity (positive polarity) opposite to the polarity (negative polarity) of charged toner T. This mechanism will now be described using a single pixel circuit 400.

When the gate driver 445 applies a voltage Vgh to the gate G of the TFT 420 via the gate line 450, a current flows between the source S and the drain D, which switches the TFT 420 to a conducting state (that is, the TFT 420 is switched ON). The gate driver 445 plays a role as a switch of the TFT 420, and in order to play this role, the gate driver 445 is able to apply two voltages Vgh and Vgl (the voltage Vgh is higher than the voltage Vgl) to the gate G. In other words, when the gate driver 445 applies the voltage Vgh to the gate G of the TFT 420, the TFT 420 is switched to a conducting state (ON state), and when it applies the voltage Vgl to the gate G of the TFT 420, the TFT 420 is switched to a non-conducting state (OFF state).

When the potential at the source S is higher than the reference potential BE while the TFT 420 remains in a conducting state, potential of the capacitor (condenser) 430 on the pixel electrode 410 side (drain D side) is higher than the potential of the capacitor (condenser) 430 on the reference potential BE side. The pixel electrode 410 is thereby charged to the positive polarity. Under these circumstances, when the source driver 455 applies a voltage higher than the reference potential BE to the source S of the TFT 420 while the gate driver 445 is applying the voltage Vgh to the gate G of the TFT 420, the TFT 420 and the capacitor 430 operate in cooperation in charging the pixel electrode 410 to the positive polarity. Negatively charged toner T is thus deposited on the pixel electrode 410 due to a Coulomb's force induced between toner T and the pixel electrode 410. Different from a case where toner is deposited via a recording sheet of paper P as is disclosed in JP-A-7-152232 supra, toner T is deposited directly on the pixel electrode 410. A distance between toner T and the pixel electrode 410 is therefore shorter, and a necessary Coulomb's force can be induced at a low voltage.

When the potential at the source S is lower than the reference potential BE, potential of the capacitor (condenser) 430 on the pixel electrode 410 side (drain D side) is lower than potential of the capacitor (condenser) 430 on the reference potential BE side. The pixel electrode 410 is therefore charged to the negative polarity. Hence, when the source driver 455 applies a voltage lower than the reference potential BE to the source S of the TFT 420 while the gate driver 445 is applying the voltage Vgh to the gate G of the TFT 420, the TFT 420 and the capacitor 430 operate in cooperation in charging the pixel electrode 410 to the negative polarity. When the pixel electrode 410 is charged to the negative polarity, a repulsion force is induced between the pixel electrode 410 and negatively charged toner T. Hence, negatively charged toner T is not deposited on the pixel electrode 410; instead, toner T is forced away from the pixel electrode 410.

As has been described, the source driver 455 plays a role in controlling the function of the TFT 420, that is, the function of depositing toner T on the pixel electrode 410 and forcing toner T away from the pixel electrode 410. In order to play this role, the source driver 455 is able to apply two voltages Vsm and Vsh both higher than the reference potential BE and one voltage Vsl lower than the reference potential BE to the source S.

In this embodiment, the voltage Vsm is 40 V, the voltage Vsh is 30V, and the voltage Vsl is 10 V. The pixel electrode 410 is charged to the positive polarity whether the source driver 455 applies the voltage Vsm or the voltage Vsl to the source S of the TFT 420. However, because the voltage Vsm is higher than the voltage Vsh, when the voltage Vsm is applied, the pixel 410 is charged to the positive polarity more strongly than when the voltage Vsh is applied. Which of the voltage Vsm and the voltage Vsh will be used is determined in a manner described in detail below.

(Example of Operations of Recording Apparatus)

Figure 5:
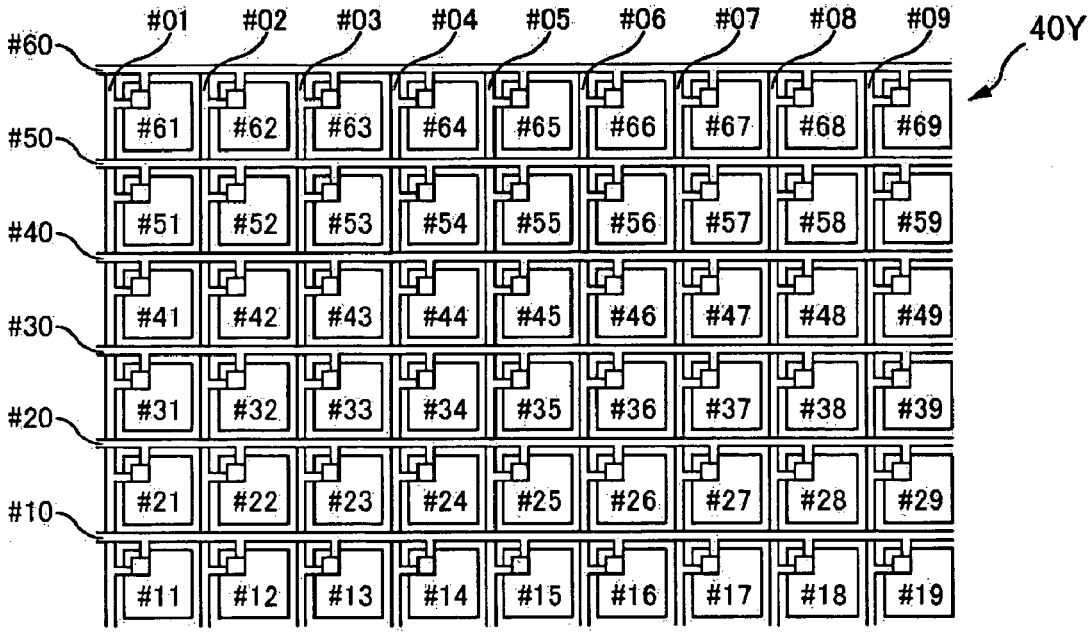
FIG. 5 is a view showing reference numerals labeled to pixel circuits (pixel electrodes and TFTs), gate lines, and source lines.
Figure 6:
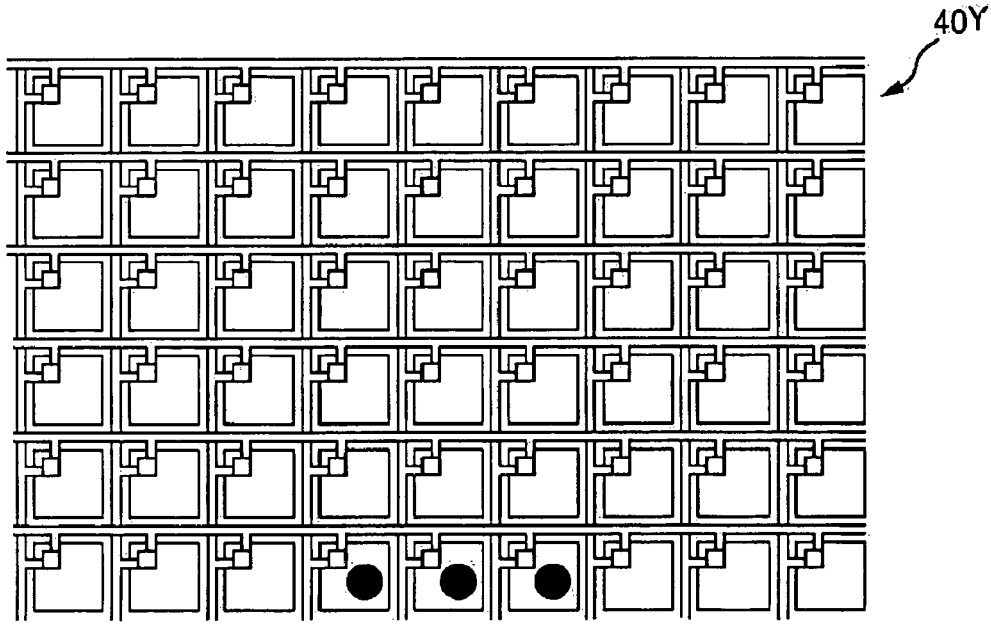
FIG. 6 is a view showing a manner in which toner is deposited on pixel electrodes.
Figure 7:
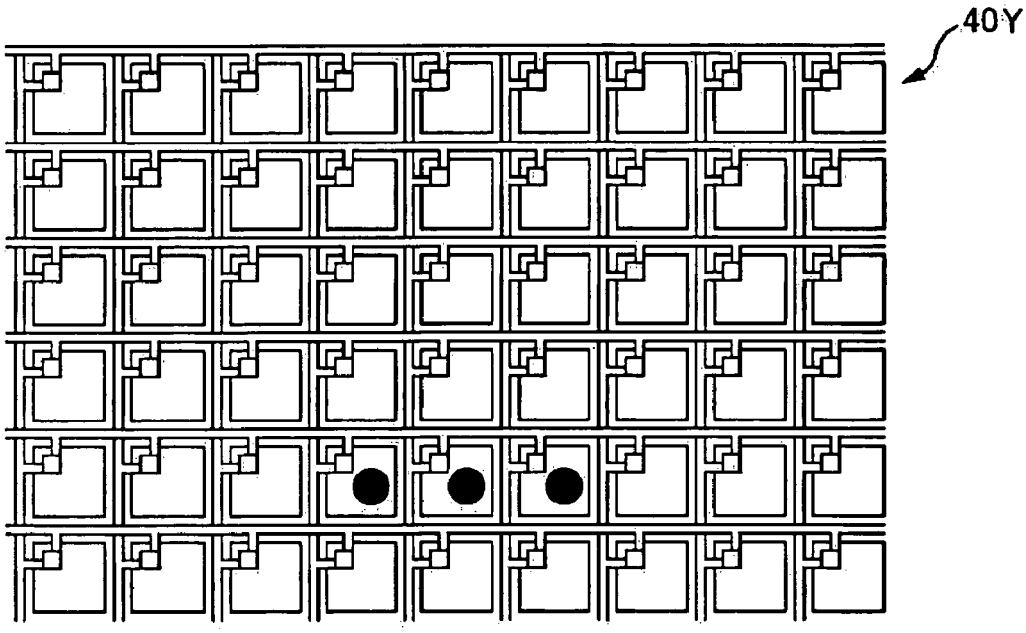
FIG. 7 is another view showing a manner in which toner is deposited on pixel electrodes.
Figure 8:
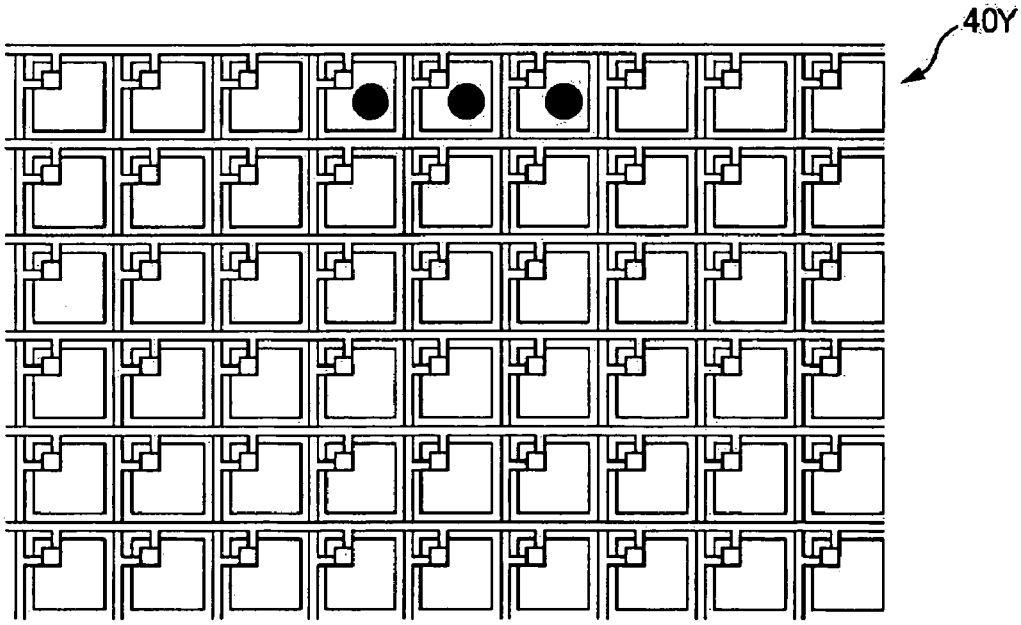
FIG. 8 is still another view showing a manner in which toner is deposited on pixel electrodes.

Operations of the printer 10 configured as described above as the recording apparatus will now be described with reference to FIG. 5 through FIG. 8. FIG. 5 is a view showing reference numerals labeled to respective pixel circuits 400 (pixel electrodes 410 and TFTs 420), gate lines 450, and source lines 460. FIG. 6 through FIG. 8 are views schematically showing a manner in which toner T is deposited on the pixel electrodes 410.

In this column, descriptions will be given to a case where a minute square, comprising 3 pixels in the longitudinal direction×3 pixels in the lateral direction, is recorded on a recording sheet of paper P using the recording heads 40Y, 40M, 40C, and 40K shown in FIG. 3 as an example of operations of the printer 10. To make following descriptions easy to understand, reference numerals are labeled as are shown in FIG. 5. That is, the pixel electrodes 400 (pixel electrodes 410 and TFTs 420) are labeled with reference numerals #11 through #19, #21 through #29, #31 through #39, #41 through #49, #51 through #59, and #61 through #69. The gate lines 450 are labeled with reference numerals #10, #20, #30, #40, #50, and #60. The source lines 460 are labeled with reference numerals #01 through #09.

When image information (image signal) and a control signal from the unillustrated host computer is inputted into the main controller 101 of the printer 10 via the interface (I/F) 112, the toner supply rollers 30Y, 30M, 30C, and 30K start to rotate under the control of the unit controller 102 at a command from the main controller 101. Toners T stored in the toner reservoir portions 20Y, 20M, 20C, and 20K and coming in contact with the toner supply rollers 30Y, 30M, 30C, and 30K reach abutting positions at which the limiting blades 35Y, 35M, 35C, and 35K abut on the rollers 30Y, 30M, 30C, and 30K in association with rotations of the respective rollers 30Y, 30M, 30C, and 30K. A layer thickness of each toner T is thus leveled off at a limited thickness when it passes by the abutting position, and toner T is also charged to the negative polarity. Negatively charged toners T on the toner supply rollers 30Y, 30M, 30C, and 30K, which are toners charged to the negative polarity with the layer thickness being leveled off at a limited thickness, reach opposing positions at which the toner supply rollers 30Y, 30M, 30C, and 30K oppose the first pixel circuits 402 on the respective recording heads 40Y, 40M, 40C, and 40K in association with further rotations of the respective toner supply rollers 30Y, 30M, 30C, and 30K.

The first TFT 422 provided to each first pixel circuit 402 on the recording head 40Y charges the first pixel electrode 412 to the positive polarity according to the image information (image signal). Negatively charged yellow (Y) toner T is thus deposited on the first pixel electrode 412. Because a minute square, comprising 3 pixels in the longitudinal direction ×3 pixels in the lateral direction, is to be recorded on the recording sheet of paper P in this embodiment, the first TFTs 422 initially charge three first pixel electrodes 412 (#14 through #16 first pixel electrodes 412) aligned in the lateral direction x. Hence, as is shown in FIG. 6, negatively charged yellow (Y) toner T is deposited on these first pixel electrodes 412.

To be more specific, the gate driver 445 applies the voltage Vgl to all the gates G in the initial state. In this instance, all the TFTs 420 are in the non-conducting state (OFF state) with the source lines 460. Subsequently, according to a control signal sent from the recording head driving control circuit 104, the gate driver 445 applies the voltage Vgh to the respective gates G of the #11 through #19 first TFTs 422 via the #10 gate line 450, while the source driver 455 applies the voltage Vsh to the respective sources S of the #14 through #16 first TFTs 422 and the voltage Vsl to the respective sources S of the #11 through #13 and #17 through #19 first TFTs 422 via the #01 through #09 source lines 460. The #14 through #16 first TFTs 422 thus charge the #14 through #16 first pixel electrodes 412 to the positive polarity, and the #11 through #13 and #17 through #19 first TFTs 422 charge the #11 through #13 and #17 through #19 first pixel electrodes 412 to the negative polarity. Consequently, negatively charged yellow (Y) toner T is deposited on the #14 through #16 first pixel electrodes 412 alone. Thereafter, the gate driver 445 applies the voltage Vgl to the respective gates G of the #11 through #19 first TFTs 422. This brings the #11 through #19 first TFTs 422 into the non-conducting state (OFF state) with all the source lines 460. Each thereby maintains the predetermined potential, which in turn allows negatively charged yellow (Y) toner T to be deposited continuously.

Subsequently, the TFTs 420 move negatively charged yellow (Y) toner T deposited on the first pixel electrodes 412 from these first pixel electrodes 412 to the second pixel electrodes 414 by way of the third pixel electrodes 416, which form a moving path for negatively charged yellow (Y) toner T from the first pixel electrodes 412 to the second pixel electrodes 414.

In this instance, the TFTs 420 move the negatively charged yellow (Y) toner T deposited on the #14 through #16 first pixel electrodes 412 to the third pixel electrodes 416 one row ahead, that is, the #24 through #26 third pixel electrodes 416. To be more specific, according to a control signal sent from the recording head driving control circuit 104, the gate driver 445 applies the voltage Vgh to the respective gates G of the #21 through #29 third TFTs 426 via the #20 gate line 450, while the source driver 455 applies the voltage Vsm to the respective sources S of the #24 through #26 third TFTs 426 and the voltage Vsl to the respective sources S of the #21 through #23 and #27 through #29 third TFTs 426 via the #01 through #09 source lines 460. Thereafter, the gate driver 445 applies the voltage Vgl to the respective gates G of the #21 through #29 third TFTs 426. This brings the #21 through #29 third TFTs 426 into the non-conducting state (OFF state) with all the source lines 460. Each thereby maintains the predetermined potential. Further, the gate driver 445 applies the voltage Vgh to the respective gates G of the #11 through #19 first TFTs 422 via the #10 gate line 450, while the source driver 455 applies the voltage Vsl to the respective sources S of the #11 through #19 first TFTs 422 via the #01 through #09 source lines 460. Thereafter, the gate driver 445 applies the voltage Vgl to the respective gates G to the #11 through #19 first TFTs 422. This brings the #11 through #19 first TFTs 422 into the non-conducting state (OFF state) with all the source lines 460. Each thereby maintains the predetermined potential. Consequently, the #24 through #26 third TFTs 426 charge the #24 through #26 third pixel electrodes 416 strongly to the positive polarity, while the #14 through #16 first TFTs 422 charge the #14 through #16 first pixel electrodes 412 to the negative polarity. Hence, as is shown in FIG. 7, negatively charged yellow (Y) toner T deposited on the #14 through #16 first pixel electrodes 412 move to the third pixel electrodes 416 one row ahead, that is, the #24 through #26 third pixel electrodes 416.

In the description above, the source driver 455 applies the voltage Vsm to the respective sources S of the #24 through #26 third TFTs 426, and the voltage Vsl to the respective sources S of the #21 through #23 and #27 through #29 third TFTs 426 via the #01 through #09 source lines 460. However, the invention is not limited to this configuration. For example, the source driver 455 may apply the voltage Vsm to the respective sources S of the #21 through #29 third TFTs 426. To be more specific, from the view point of appropriately moving negatively charged yellow (Y) toner T deposited on the #14 through #16 first pixel electrodes 412 to the #24 through #26 third pixel electrodes 416 (parallel translation by one row), the voltages at the respective sources S of the #21 through #23 and #27 through #29 third TFTs 426 can be either the voltage Vsm or the voltage Vsl. However, in a case where negatively charged yellow (Y) toner T is deposited on the #11 through #13 and #17 through #19 first pixel electrodes 412 erroneously, the voltage Vsl is preferable as the voltage at the respective sources S of the #21 through #23 and #27 through #29 third TFTs 426 in prohibiting movements of such negatively charged yellow (Y) toner T to the third pixel electrodes 416 one row ahead.

At timing at which movements of the negatively charged yellow (Y) toner T to the third pixel electrodes 416 have been completed, the gate driver 445 applies the voltage Vgh to the respective gates G of the #21 through #29 third TFTs 426 via the #20 gate line 450, while the source driver 455 applies the voltage Vsh to the respective sources S of the #24 through #26 third TFTs 426 via the #04 through #06 source lines 460. This causes the potential at the sources S to shift from Vsm to Vsh, and the #24 through #26 third pixel electrodes 416 in the strongly charged state shift to a less strongly (normal) charged state.

Further, by following the principle as described above, the TFTs 420 move the negatively charged yellow (Y) toner T that has moved to the #24 through #26 third pixel electrodes 416 to the #34 through #36 third pixel electrodes 416, and move the negatively charged yellow toner (Y) toner T that has moved to the #34 through #36 third pixel electrodes 416 to the #44 through #46 third pixel electrodes 416. Further, the TFTs 420 move the negatively charged yellow (Y) toner T that has moved to the #44 through #46 third pixel electrodes 416 to the #54 through #56 third pixel electrodes 416, and finally, move the negatively charged yellow (Y) toner T that has moved to the #54 through #56 third pixel electrodes 416 to the #64 through #66 second pixel electrodes 414 (FIG. 8).

Subsequently, the second TFTs 424, in cooperation with the back plate 50Y, cause the negatively charged yellow (Y) toner T, which has moved to the second pixel electrodes 414 and is now deposited on these second pixel electrodes 414, to be transferred onto a recording sheet of paper P.

To be more specific, according to a control signal sent from the recording head driving control circuit 104, the gate driver 445 applies the voltage Vgh to the respective gates G of the #61 through #69 second TFTs 424 via the #60 gate line 450, while the source driver 455 applies the voltage Vsl to the respective sources S of the #61 through #69 second TFTs 424 via the #01 through #09 source lines 460. The #64 through #66 second TFTs 424 thereby charge the #64 through #66 second pixel electrodes 414 to the negative polarity. Meanwhile, the back plate 50Y, which opposes these second pixel electrodes 414 via the recording sheet of paper P, is charged strongly to the positive polarity according to a control signal sent from the back plate driving control circuit. The second TFTs 424 thereby force the negatively charged yellow (Y) toner T deposited on the #64 through #66 second pixel electrodes 414 away from these second pixel electrodes 414, while the back plate 50Y attracts negatively charged yellow (Y) toner T deposited on the #64 through #66 second pixel electrodes 414 toward the recording sheet of paper P. The negatively charged yellow (Y) toner T attracted toward the recording sheet of paper P thus adheres onto the recording sheet of paper P, at which point the negatively charged yellow (Y) toner T is transferred onto the recording sheet of paper P. The recording sheet of paper P is fed from the paper feeding tray 94 by means of the paper feeding rollers 96.

As has been described, of the minute square comprising 3 pixels in the longitudinal direction ×3 pixels in the lateral direction, one row is recorded on the recording sheet of paper P in yellow (Y) toner T. The processing as described above is repeated twice to record the minute square comprising 3 pixels in the longitudinal direction ×3 pixels in the lateral direction on the recording sheet of paper P in yellow (Y) toner T. In this instance, the recording sheet of paper P is transported row by row by means of the transportation rollers 98. Herein, transportation row by row was described; however, simultaneous transportation by more than one row (plane-by-plane) is also preferable. In such a case, parallel processing is performed, in which transportation procedure for respective rows are overlapped in terms of time.

Further, the processing described above is performed for the second color (magenta), the third color (cyan), and the fourth color (black) sequentially using, respectively, the recording heads 40M, 40C, and 40K to record a full-color image (minute square) on the recording sheet of paper P. The full-color image recorded on the recording sheet of paper P is heated and pressed in the fixing unit 90 and is thereby fusion bonded to the recording sheet of paper P. The recording sheet of paper P on which is recorded the full-color image is discharged to an unillustrated paper releasing portion in the end.

In the above description, the first pixel electrodes 412 bearing toner T according to the image information of the image, and the first TFTs 422 that deposit toner T on the first pixel electrodes 412 according to the image information are present at the lowermost position of the recording heads 40Y, 40M, 40C, and 40K opposing the toner supplying rollers 30Y, 30M, 30C, and 30K, respectively. However, the invention is not limited to this configuration. For example, the first pixel electrodes 412 and the first TFTs 422 may be located at position (upper than the lowermost position) at which none of them opposes the toner supplying rollers 30Y, 30M, 30C, and 30K. In such a case, the TFTs 420 move toner T from the pixel electrodes 410 present at the lowermost position of the recording heads 40Y, 40M, 40C, and 40K to the front of the first pixel electrodes 412. The first TFTs 422 then deposit toner T on the first pixel electrodes 412 according to the image information.

(Effectiveness of Recording Head and Recording Apparatus of the Invention)

It has been already described in the related art column that, as a recording apparatus, such as a printer, there is an apparatus that records an image on a medium, such as a recording sheet of paper, by transferring a recording agent, such as toner, onto the medium through the control of active elements, such as thin film transistors (TFTs), according to image information of the image.

In an example of such a recording apparatus as is disclosed in JP-A-11-78104 supra, a recording agent supply (reservoir) device is placed oppositely to a medium via an aperture electrode body, and whether or not the recording agent within the recording agent supply (reservoir) device is allowed to pass through the aperture electrode body is controlled by means of active elements according to image information of an image. The recording agent is therefore transferred onto the medium according to the image information, and the image is thus recorded on the medium.

In another example of such a recording apparatus as is disclosed in JP-A-7-152232 supra, a recording agent supply (reservoir) device is placed oppositely to an electrode via a medium, and potential of the electrode is controlled by means of active elements according to image information of an image. The charged recording agent within the recording agent supply (reservoir) device is therefore transferred onto the medium according the image information, and the image is thus recorded on the medium.

Both examples of the recording apparatus, however, have problems as follows. That is, when the method using apertures (openings) as is disclosed in JP-A-11-78104 supra is adopted, the apertures are narrowed when resolution is increased, which readily gives rise to clogging. It is therefore difficult to achieve a fast, high-resolution, and yet reliable product. With the method disclosed in JP-A-7-152232 supra, because the recording agent supply (reservoir) device itself opposes the medium, it is highly probable that the recording agent within the recording agent supply (reservoir) device adheres to the medium in spite of the control described above. When such an event takes place, an image is not recorded on the medium according to the image information, and the image quality is deteriorated. In addition, because an electric field is applied via the medium, most of a voltage for controlling the recording agent is applied to the medium. Hence, an extremely high voltage (some hundreds V) needs to be applied to TFTs. This, however, is infeasible in a practical process using TFTs of a practical size.

On the contrary, the recording apparatus (printer 10) of this embodiment is provided with the recording heads 40Y, 40M, 40C, and 40K, each having the pixel electrodes 410 on which is deposited toner T to be transferred onto a recording sheet of paper P for the image to be recorded thereon, and the TFTs 420 that deposit toner T on the pixel electrodes 410 according to the image information of the image. Hence, it is possible to place only the toner T deposited on the pixel electrodes 410 according to the image information oppositely to the recording sheet of paper P. This eliminates the problem that toner T adheres onto the recording sheet of paper P in spite of the control using the active elements, and it is therefore sufficient to apply a low voltage to the TFTs in the recording apparatus (printer 10) of this embodiment. An image can be thus recorded onto the recording sheet of paper P according to the image information in a reliable manner, which in turn makes it possible to record a high-quality image on the recording sheet of paper P.

(Other Embodiments)

While one embodiment of the recording head of the invention has been described for the purpose of better understanding of the invention without any intention to limit the invention, it goes without saying that the invention can be changed or modified without deviating from the scope of the invention, and that equivalents are included in the invention.

The embodiment above described the full-color printer 10 as an example of the recording apparatus; however, the invention is also applicable as a monochrome printer. Further, in addition to the printer, the invention is also applicable to various kinds of recording apparatus, such as a plotter, a copying machine, and a facsimile machine.

The embodiment above described a recording sheet of paper P as an example of the medium. However, the invention is not limited to this configuration. For example, the medium can be a medium used when toner is transferred onto a recording sheet of paper, that is, a so-called intermediate transfer medium. In other words, the recording head does not necessarily record an image directly on a recording sheet of paper, and instead, the recording head may record an image on the intermediate transfer medium first, and then the image recorded on the intermediate transfer medium is recorded on a recording sheet of paper.

The embodiment above described dry toner T as an example of a recording agent. However, the invention can use any recording agent that can be charged. For example, liquid toner or ink may be used. In a case where liquid toner or ink is used, charged droplets are transported by exploiting liquid repellency.

The embodiment above described the thin film transistors (TFTs 420) as an example of the active elements. However, the invention is not limited to this configuration. For example, thin film diodes (TFDs) may be used instead.

However, because the TFTs 420 have excellent switching capability, they can deposit toner T on the pixel electrodes 410 swiftly. For this reason, the embodiment above is more preferable than the alternative.

The embodiment above described the pixel electrodes 410 as an example of the recording agent bearing portion. However, the invention is not limited to this configuration. For example, the recording agent bearing portion may comprise the pixel electrodes 410 and a thin protective film made of silicon dioxide to protect the pixel electrodes 410. Alternatively, a protective film made of silicon dioxide or the like may be provided to the entire recording heads including the wiring regions (gate lines and source lines) to prevent leakage of charges and canceling out of charged toner and charges, or to improve the flatness or smoothness of the surface.

In the embodiment above, the recording head driving control circuit 104 is provided to the unit controller 102. However, the invention is not limited to this configuration. For example, it may be provided to the recording heads 40Y, 40M, 40C, and 40K. In addition, the recording head driving control circuit 104, the gate river 445, and the source driver 455 may be made of low-temperature polycrystalline silicon.

In the embodiment above, when toner T is transferred onto the recording sheet of paper P, the TFTs 420 force negatively charged toner T that is deposited on the pixel electrodes 410 away from the pixel electrodes 410 by charging the pixel electrodes 410 to the negative polarity. However, the invention is not limited to this configuration. For example, when toner T is transferred onto the recording sheet of paper P, the pixel electrodes 410 may not be charged to the negative polarity (in other words, negatively charged toner T is attracted onto the recording sheet of paper P due to only a Coulomb's force induced between the positively charged back plate 50Y and the negatively charged toner T).

It should be noted, however, that the embodiment above is more preferable because toner T can be transferred onto the recording sheet of paper P more appropriately.

In the embodiment above, the recording heads 40Y, 40M, 40C, and 40K are shaped like a flat plate (in this case, a direction heading toward the second pixel electrodes 414 from the first pixel electrodes 412 goes along a direction heading toward the third pixel electrodes 416 from the first pixel electrodes 412). However, the invention is not limited to this configuration. For example, as is shown in FIG. 9, the recording heads 40Y, 40M, 40C, and 40K may be curved, so that a direction heading toward the second pixel electrodes 414 from the first pixel electrodes 412 does not go along a direction heading toward the third pixel electrodes 416 from the first pixel electrodes 412.

Figure 9:
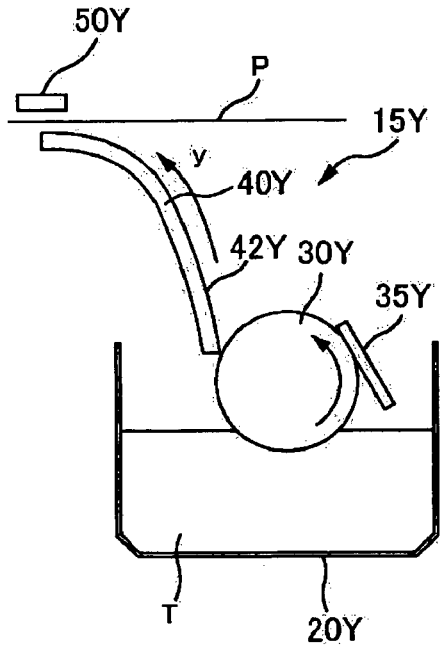
FIG. 9 is a view showing a recording unit provided with a recording head according to another embodiment.

When the recording heads 40Y, 40M, 40C, and 40K are configured in this manner, as is shown in FIG. 9, it is possible to dispose the recording heads 40Y, 40M, 40C, and 40K in such a manner that the image recording surface of the recording sheet of paper P is parallel to the toner-bearing surface of the second pixel electrodes 414 opposing the recording sheet of paper P. Hence, this case is advantageous in that toner T deposited on the second pixel electrodes 414 can be transferred onto the recording sheet of paper P more appropriately. FIG. 9 is a view showing a recording unit 15Y provided with a recording head 40Y according to another embodiment.

In the embodiment above, each of the recording heads 40Y, 40M, 40C, and 40K is provided with, as the pixel electrodes 410, the first pixel electrodes 412 that bear toner T according to the image information of an image, the second pixel electrodes 414 that oppose a recording sheet of paper P, and the third pixel electrodes 416 that form a moving path for toner T from the first pixel electrodes 412 to the second pixel electrodes 414. The TFTs 420 deposit toner T on the first pixel electrodes 412 according to the image information of the image first, and then move the toner T to the second pixel electrodes 414 from the first pixel electrodes 412 by way of the third pixel electrodes 416. The TFTs 420 then force the toner T that has moved to the second pixel electrodes 414 away from the second pixel electrodes 414. The invention, however, is not limited to this configuration.

For example, the recording heads 40Y, 40M, 40C, and 40K may be configured as follows. That is, the pixel electrodes 410 are allowed to move, and after the TFTs 420 deposit toner T on the pixel electrodes 410 according to the image information of the image, the pixel electrodes 410 bearing toner T are moved to an opposing position at which they oppose the recording sheet of paper P. The TFTs 420 then force the toner T deposited on the pixel electrodes 410 that have moved to the opposing position away from the pixel electrode pixels 410.

Figure 10:
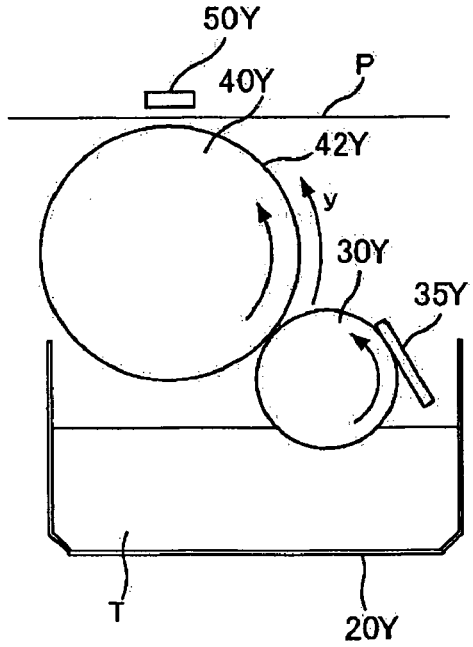
FIG. 10 is a view showing a recording unit provided with a recording head according to still another embodiment.

The configuration of the recording heads 40Y, 40M, 40C, and 40K that can achieve the description above will now be described with reference to FIG. 10. FIG. 10 is a view showing a recording unit 15Y provided with a recording head 40Y according to still another embodiment. The recording heads 40Y, 40M, 40C, and 40K are cylindrical members having pixel electrodes 410 (pixel circuits 400) on their respective surfaces 42Y, 42M, 42C, and 42K. The recording heads 40Y, 40M, 40C, and 40K are supported rotatably on unillustrated recording head supporting portions, and are configured in such a manner that the pixel electrodes 410 (pixel circuits 400) are allowed to move in association with rotations of the recording heads 40Y, 40M, 40C, and 40K.

When negatively charged toners T on the toner supply rollers 30Y, 30M, 30C, and 30K reach the opposing positions at which the toner supply rollers 30Y, 30M, 30C, and 30K oppose the pixel electrodes 410 in the recording heads 40Y, 40M, 40C, and 40K, the TFTs 420 deposit negatively charged toners T on the corresponding pixel electrodes 410 according to the image information (image signal). In association with rotations of the recording heads 40Y, 40M, 40C, and 40K, the pixel electrodes 410 bearing negatively charged toners T move to the opposing position at which they oppose the recording sheet of paper P. The TFTs 420 then force toners T deposited on the corresponding pixel electrodes 410 that have moved to the opposing position away from the pixel electrodes 410, while the back plates 50Y, 50M, 50C, and 50K attract toners T toward the recording sheet of paper P. The negatively charged toners T attracted toward the recoding sheet of paper P thereby adhere onto the recording sheet of paper P, at which point the negatively charged toners T are transferred onto the recording sheet of paper P.

Advantages of the recording heads 40Y, 40M, 40C, and 40K shown in FIG. 1 (or FIG. 9) and advantages of the recording heads 40Y, 40M, 40C, and 40K shown in FIG. 10 will now be discussed through comparison between the former and the latter.

As is obvious from the description above, a difference between the former and the latter is the absence or presence of the pixel electrodes 410 that form a moving path for toner T from the pixel electrodes 410 bearing toner T according to the image information of the image to the pixel electrodes 410 opposing the recording sheet of paper P. In other words, in the case of FIG. 1 (or FIG. 9), toners T move on the surfaces (pixel electrodes 410) of the recording heads 40Y, 40M, 40C, and 40K, whereas in the case of FIG. 10, toners T do not move on the surfaces (pixel electrodes 410) of the recording heads 40Y, 40M, 40C, and 40K; instead, they move integrally with the corresponding pixel electrodes 410 (pixel circuits 400).

Hence, in the case of FIG. 10, it is possible to omit the control by means of the TFTs 420 to move toner T from the pixel electrodes 410 bearing toner T according the image information of an image to the pixel electrodes 410 opposing a recording sheet of paper P. An advantage in this case is therefore in that control performed by means of the TFTs 420 can be simplified.

On the other hand, in the case of FIG. 1 (or FIG. 9), it is configured in such a manner that toners T move on the surfaces (pixel electrodes 410) of the recording heads 40Y, 40M, 40C, and 40K, as has been described. An advantage in this case is therefore in that it is possible to take a countermeasure to prevent toner T deposited erroneously on the first pixel electrodes 412 from being deposited on the second pixel electrodes 414 opposing the recording sheet of paper P in the end.

In the embodiment above, the thin film transistors (TFTs 420) are made of low-temperature polycrystalline silicon. However, the invention is not limited to this configuration. For example, the thin film transistors (TFTs 420) may be made of amorphous silicon. It should be noted, however, that the embodiment above is more preferable in that recording heads 40Y, 40M, 40C, and 40K having highly accurate thin film transistors (TFTs 420) can be readily manufactured. In a case of FIG. 9 or FIG. 10, an advantage as follows can be achieved when the thin film transistors (TFTs 420) are organic transistors instead of the inorganic transistors as described above. That is, because organic transistors have excellent elasticity in comparison with transistors made of low-temperature polycrystalline silicon, the recording heads 40Y, 40M, 40C, and 40K shown in FIG. 9 or FIG. 10 can be readily manufactured.

(Example of Configuration of Recording System)

A recording system according to one embodiment of the invention will now be described by way of example with reference to the drawings.

Figure 11:
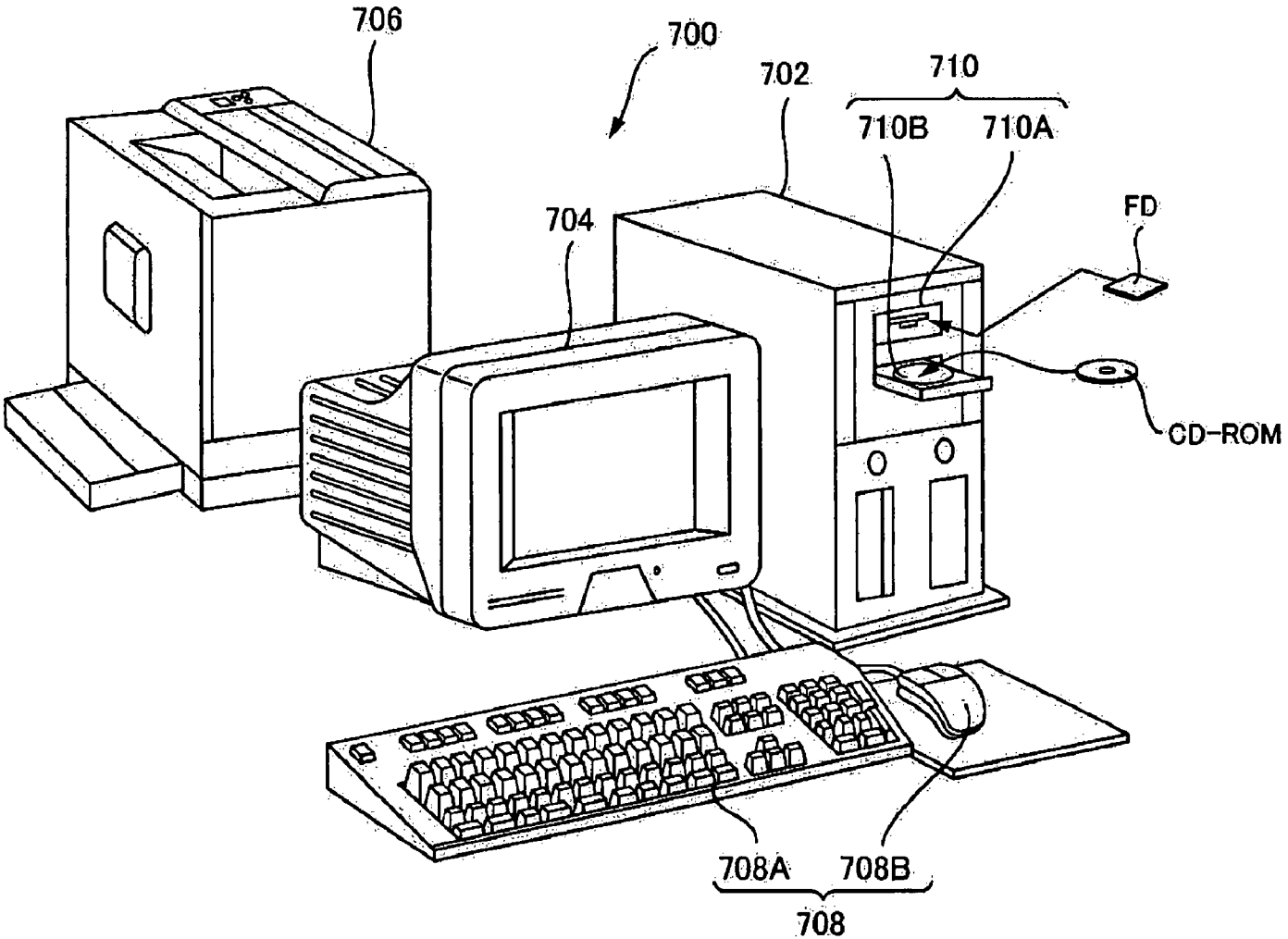
FIG. 11 is a view used to describe the outward configuration of a recording system.

FIG. 11 is a view used to describe the outward configuration of a recording system. A recording system 700 is provided with a computer 702, a display device 704, a printer 706, an input device 708, and a reading device 710. The computer 702 is housed in a mini-tower type housing in this embodiment; however, the invention is not limited to this configuration. As the display device 704, a CRT (Cathode Ray Tube), a plasma display, a liquid crystal display or the like is normally used; however, the invention is not limited to this configuration. The printer described above is used as the printer 706. The input device 708 comprises a keyboard 708A and a mouse 708B in this embodiment; however, the invention is not limited to this configuration. As the reading device 710, a flexible disc driver 710A and a CD-ROM driver 710B are used in this embodiment; however, the invention is not limited to this configuration. For example, an MO (Magento Optical) disc driver, or a DVD (Digital Versatile Disc) player or the like may be used as well.

Figure 12:
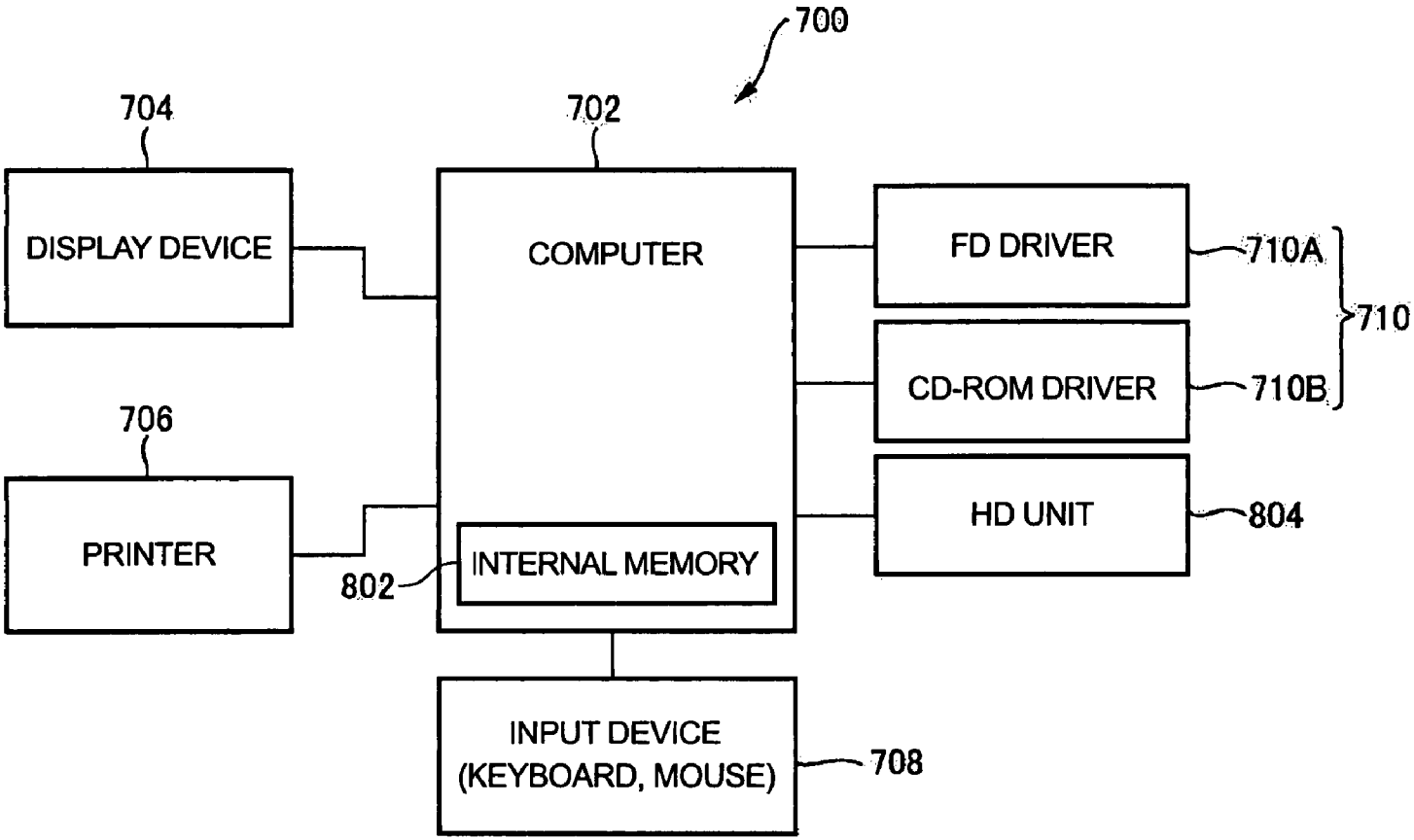
FIG. 12 is a block diagram showing the configuration of the recording system shown in FIG. 11.

FIG. 12 is a block diagram showing the configuration of the recording system shown in FIG. 11. An internal memory 802, such as a RAM, and an external memory, such as a hard disc drive unit 804, are further provided inside the housing in which the computer 702 is accommodated.

Descriptions were given for a case where the recording system is configured in such a manner that the computer 702, the display device 704, the input device 708, and the reading device 710 are connected to the printer 706; however, the invention is not limited to this configuration. For example, the recording system may comprise the computer 702 and the printer 706, and any of the display device 704, the input device 708, and the reading device 710 may be omitted from the recording system.

Alternatively, the printer 706 may be furnished with part of the function or the mechanism of the computer 702, the display device 704, the input device 708, and the reading device 710. For example, the printer 706 may be configured in such a manner that it is provided with an image processing portion that performs image processing, a display portion that displays images of various kinds, and a recording media insert/eject portion used to insert/eject a recording medium having recoded image data taken by a digital camera or the like.

The recording system achieved in this manner as a whole is a system that outperforms the system in the related art.

What is claimed is:

1. A recording head that records an image on a medium, comprising:

a plurality of recording agent bearing portions each operable for bearing a recording agent to be transferred onto the medium for the image to be recorded thereon, the plurality of recording agent bearing portions arranged in a grid having a plurality of rows extending in a first direction and a plurality of columns extending in a second direction;

a plurality of active elements, each operatively coupled to a corresponding one of the plurality of recording agent bearing portions to deposit the recording agent on the corresponding recording agent bearing portion according to image information of the image, wherein each of the active elements is operatively connected to a gate line common to each of the active elements in the respective row, and wherein each of the active elements is operatively connected to a source line common to each of the active elements in the respective column; and a source driver operatively connected to each of the plurality of active elements via the source lines and a gate driver operatively connected to each of the plurality of active elements via the gate lines to individually control voltages for each of the active elements, wherein the active elements are controlled by applying at least two voltages that are higher than a reference potential and at least one voltage that is less than the reference potential.

2. The recording head according to claim 1, wherein:

each of the plurality of active elements is a thin film transistor.

3. The recording head according to claim 1, wherein:

each recording agent bearing portion and corresponding active element corresponds to one pixel in the image.

4. The recording head according to claim 1, wherein:

the recording agent is charged to a specific polarity; and each of the plurality of active elements deposits the recording agent on the corresponding recording agent bearing portion according to the image information of the image by charging the corresponding recording agent bearing portion to a polarity opposite to the specific polarity.

5. The recording head according to claim 4, wherein:

each of the plurality of active elements charges the corresponding recording agent bearing portion to the specific polarity when the recording agent is transferred onto the medium, so that the recording agent deposited on the recording agent bearing portion is forced away from the recording agent bearing portion.

6. The recording head according to claim 5, wherein, as the recording agent bearing portion, the recording head includes:

a first recording agent bearing portion that bears the recording agent according to the image information of the image;

a second recording agent bearing portion that opposes the medium; and a third recording agent bearing portion that forms a moving path for the recording agent from the first recording agent bearing portion to the second recording agent bearing portion, and wherein a first active element deposits the recording agent on the first recording agent bearing portion according to the image information of the image, then a second active element moves the recording agent to the second recording agent bearing portion from the first recording agent bearing portion by way of the third recording agent bearing portion, and forces the recording agent that has moved to the second recording agent bearing portion away from the second recording agent bearing portion.

7. The recording head according to claim 6, wherein:

the recording head is curved; and a direction heading toward the second recording agent bearing portion from the first recording agent bearing portion does not go along a direction heading toward the third recording agent bearing portion from the first recording agent bearing portion.

8. The recording head according to claim 1, wherein:

the plurality of active elements are thin film transistors; and the thin film transistors are made of low-temperature polycrystalline silicon.

9. A recording head that records an image on a medium, comprising:

a plurality of recording agent bearing portions each operable for bearing a recording agent to be transferred onto the medium for the image to be recorded thereon, the plurality of recording agent bearing portions arranged in a grid having a plurality of rows extending in a first direction and a plurality of columns extending in a second direction;

a plurality of active elements, each operatively coupled to a corresponding one of the plurality of recording agent bearing portions to deposit the recording agent on the corresponding recording agent bearing portion according to image information of the image, wherein each of the active elements is operatively connected to a gate line common to each of the active elements in the respective row, and wherein each of the active elements is operatively connected to a source line common to each of the active elements in the respective column; and a source driver operatively connected to each of the plurality of active elements via the source lines and a gate driver operatively connected to each of the plurality of active elements via the gate lines to individually control voltages for each of the active elements, wherein the active elements are controlled by applying at least two voltages that are higher than a reference potential and at least one voltage that is less than the reference potential, wherein:

each of the active elements is a thin film transistor;

the recording agent bearing portion and the active element in each set correspond to one pixel in the image;

the recording agent is charged to a specific polarity;

each active element deposits the recording agent on the corresponding recording agent bearing portion according to the image information of the image by charging the corresponding recording agent bearing portion to a polarity opposite to the specific polarity;

each active element charges the corresponding recording agent bearing portion to the specific polarity when the recording agent is transferred onto the medium, so that the recording agent deposited on the corresponding recording agent bearing portion is forced away from the corresponding recording agent bearing portion;

the plurality of recording agent bearing portions include, a first recording agent bearing portion that bears the recording agent according to the image information of the image, a second recording agent bearing portion that opposes the medium, and a third recording agent bearing portion that forms a moving path for the recording agent from the first recording agent bearing portion to the second recording agent bearing portion;

and wherein the plurality of active elements includes a first active element that deposits the recording agent on the first recording agent bearing portion according to the image information of the image, and a second active element that moves the recording agent to the second recording agent bearing portion from the first recording agent bearing portion by way of the third recording agent bearing portion, and forces the recording agent that has moved to the second recording agent bearing portion away from the second recording agent bearing portion; and the thin film transistor is made of low-temperature polycrystalline silicon.

* * * * *